US005479870A

United States Patent [19]

Corzine

[11] Patent Number: 5,479,870

[45] Date of Patent: Jan. 2, 1996

[54] RUNAWAY HALYARD STOP

[76] Inventor: John E. Corzine, 72 Cranberry Rd., Rochester, N.Y. 14612

[21] Appl. No.: 408,059

[22] Filed: Mar. 21, 1995

[51] Int. Cl.[6] ..... B63B 21/08

[52] U.S. Cl. ..... 114/102; 114/199

[58] Field of Search ..... 114/90, 89, 39.1, 114/39.2, 199, 218; 24/132 R, 134 R, 132 AA, 1.5 G; 242/147 R; 188/65.1

[56] References Cited

U.S. PATENT DOCUMENTS

| | | | |
|---|---|---|---|
| D. 257,323 | 10/1980 | Merry . | |
| 466,736 | 1/1892 | Dean . | |
| 858,018 | 6/1907 | Petersen . | |
| 1,650,281 | 11/1927 | Knudson | 114/199 |
| 1,710,697 | 4/1929 | Gilbert | 114/199 |
| 3,186,372 | 6/1965 | Cleveland | 114/199 |
| 3,343,514 | 9/1967 | Brettt . | |
| 3,843,999 | 10/1974 | Kramoski . | |
| 4,051,798 | 10/1977 | Wade et al. . | |
| 4,147,121 | 4/1979 | Fogh et al. . | |
| 4,166,427 | 9/1979 | Bullard . | |
| 4,465,011 | 8/1984 | Merry . | |
| 5,113,776 | 5/1992 | Knecht . | |
| 5,152,241 | 10/1992 | Brown et al. . | |

*Primary Examiner*—Stephen Avila
*Attorney, Agent, or Firm*—Eugene Stephens & Associates

[57] ABSTRACT

This runaway halyard preventer has a relatively small, elongated stop body that has one of its ends pivotally attached to the mast below the halyard pulley, while its other end is cantilevered. The stop body includes a walled passageway, located near the pivoted end, through which the halyard is passed. Whenever the halyard is under tension, the force it exerts on the stop body readily moves the stop body to a first position in which the halyard is able to run freely through the stop body in either direction. However, whenever the halyard is not under tension, a slight biasing force moves the pivoted stop body to a second position in which its passageway walls create sufficient frictional resistance to prevent movement of the halyard in either direction. Preferably, the weight of the cantilever end provides appropriate force for biasing the pivoted stop body toward its second position.

13 Claims, 2 Drawing Sheets

RUNAWAY HALYARD STOP

TECHNICAL FIELD

The invention relates to marine tackle. More particularly, it relates to a stop for a line used with a pulley, e.g., a sail or flag halyard.

BACKGROUND OF INVENTION

A common form of lifting tackle used on boats consists of a line run over a pulley (sometimes called a block or sheave). The line has a lifting end that is attached to the object being raised and a working end that is placed under tension to raise or secure the object at a position above the deck. The bight of the line is run over the pulley, and the pulley is fastened at a position above the location to which the object is to be raised (usually high above the deck near the top of the mast). The bight of the line is divided into two lengths separated at the point where it passes over the pulley. Namely, the bight has a lifting length, positioned between the pulley and the lifting end, and a working length positioned between the pulley and the deck.

When the object being raised is a sail or a flag, the line is called a halyard. Whenever the sail is raised to and secured in its desired location, the halyard is placed under tension and its working length is aligned in a predetermined halyard-under-tension direction.

A particularly serious problem can occur when a sailor is in the process of attaching the lifting end of the halyard to a sail or flag. Often, the sailor is holding the lifting end of the halyard several feet above the deck, while the working length of the halyard is extended from the pulley all the way down to the deck or, at least, to a location lower than the level at which the lifting end is being held. At this moment, the working length may be several feet longer than the lifting length, and it weighs more than the lifting length. If, at such a time, the lifting end of the halyard is lost from the sailor's grip, the difference between the relative weights of the two line lengths creates a moment which starts the pulley rotating in the direction of the heavier working length; and this rotational force very rapidly increases as the free lifting end moves upward and becomes continuously lighter relative to the weight of the working length. Therefore, unless the sailor is able to quickly regain a grip on the lifting end, the halyard will runaway, running fully off the pulley or, if it is knotted to a shackle, leaving the lifting end jammed in the pulley high above the deck.

It should be noted that this problem is quite different from the more common problem experienced with such tackle. That is, whenever a halyard is under load, there is always the danger that the sailor's grip may be lost on the working length. For instance, when raising a jib sail, the wind may suddenly fill the sail, wrenching the halyard out of the sailor's hand. To secure the working end of the line, or to prevent its being dragged through the pulley by the sail or other load being raised by the lifting end, the working end is usually passed around a fixed cleat or pulled through a tension-activated or hand-activated cam-action cleat or stopper. Such activated belaying mechanisms have an increasingly narrowing passageway (usually provided with saw-tooth like surfaces) that close around the line with a grip that increases in direct proportion to the tension of the load being raised or secured.

There are many known variations of hand- or tension-activated cam-cleat type stoppers designed for lifting tackle to prevent the working end of the line from running away under load. One such known line-locker, which is specifically designed for anchor line tackle, grips the working length of the anchor line between the deck and one end of a pivoted clamping bar in the event (a) tension is released on the working end of the line and (b) the line begins to run out under the weight of the anchor. In this anchor line stopper, the working length of the line is subjected to adjacent reverse bends by being passed over two adjacent rope guides, one of which is secured to the deck and the other to the clamping bar; and the clamping bar, which is biased toward its clamping position by gravity, is pulled down toward the deck so that it clamps down on the line with a force proportional to the tension exerted on the lifting length by the weight of the anchor.

As just stated above, these known halyard stops and clamps are directed to the problem of securing the working end of the line when the lifting end is under tension. They are not directed to, nor can they be used to solve, the problem solved by my invention, namely, the problem of a runaway halyard caused by a loss of tension on the lifting length of the tackle.

SUMMARY OF THE INVENTION

My runaway halyard preventer, in its simplest preferred form, has a stop body comprising a relatively small, elongated block of dense material (e.g., metal) that has one of its ends pivotally attached to the mast below the pulley, while its other end is cantilevered. The stop body includes a walled passageway, located near the pivoted end, through which the working length of the halyard bight is passed.

Whenever the halyard is under tension, the pivoted stop body moves to a first position in which the passageway is substantially aligned in the halyard-under-tension direction so that its walls create little, if any, frictional resistance to movement of the working length of the halyard. However, whenever the halyard is not under tension, the pivoted stop body moves to a second position in which the passageway is out of alignment with the halyard-under-tension direction so that its walls create frictional resistance to movement of the halyard's working length.

Preferably, the passageway is perpendicular to the pivot axis, and the weight of the cantilever end biases the pivoted stop body toward its second position. The biasing force is selected so that the stop body is pivoted to a position in which the frictional resistance created by the passageway walls is sufficient to prevent movement of the working length whenever the halyard is not under tension but is insufficient to prevent movement of the working length whenever the halyard is under tension. That is, whenever the halyard is under tension, the force it exerts on the stop body readily overcomes the biasing force to pivot the stop body to its first position in which the halyard is able to run freely through the stop body in either direction. However, whenever the halyard is not under tension, the friction of the lightly biased stop body prevents movement of the halyard through the passageway in either direction. For most halyards, the weight of the cantilever end of the stop body is the only biasing force that is needed. However, in order to prevent movement of some wire halyards, it may be necessary to supplement this biasing force with a small spring.

In the disclosed preferred embodiments, the stop body is a single block of stainless steel pivoted on a stainless pin held in a stamped stainless bracket that is attached to the mast by screws. Also, the passageway through the stop body is lined with a bushing in the form of an insertable cartridge with dimensions that can be selected in accordance with the type and diameter of the halyard with which my invention is to be used.

DRAWINGS

DETAILED DESCRIPTION

Figure 1:
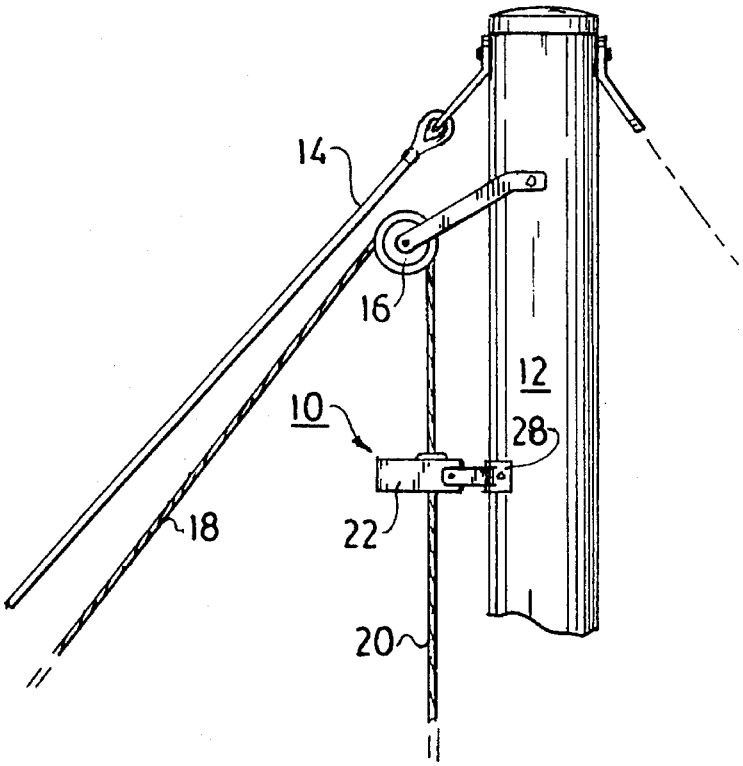
FIG. 1 is a schematic diagram of a portion of the top of a boat mast, showing the relative position of my invention installed on a sail halyard.

Referring first to FIG. 1, my runaway halyard stop 10 is shown attached to a mast 12 that is supported, in part, by a forestay 14. Runaway halyard stop 10 is positioned a short distance below a jib halyard pulley 16 which is also suitably attached to the top region of mast 12. [Note: While the drawing and the following explanation describe pulley 16 as being fastened to the exterior surface of mast 12, the invention is equally applicable to well-known sail-raising tackle arrangements in which the pulley is mounted inside the top of a hollow mast.]

A sail halyard runs over pulley 16, the lifting length 18 of the halyard being connected to the head of a jib sail (not shown), while the working length 20 of the sail halyard is shown aligned in its halyard-under-tension direction, being threaded through runaway halyard stop 10 and secured under tension to an appropriate cleat (not shown). [Again, as just noted above, working length 20 can also be located in the interior of a hollow mast. For such rigs, runaway halyard stop 10 is merely fastened within the mast at a location below the pulley.]

Figure 2:
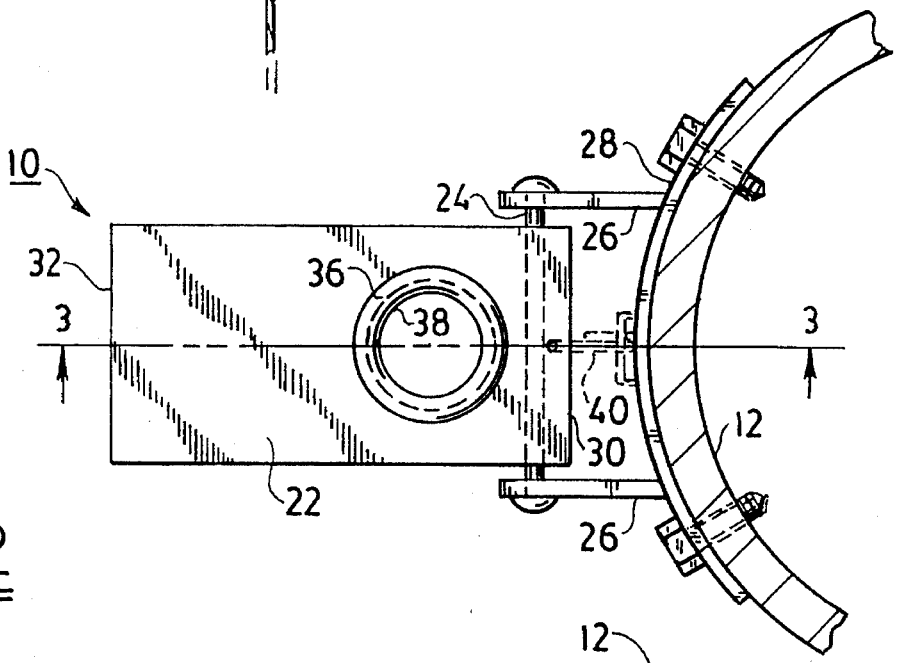
FIGS. 2 and 3 are, respectively, a top view and a side view of my runaway halyard stop, FIG. 3 being a cross section taken in the direction of A—A in FIG. 1.
Figure 3:
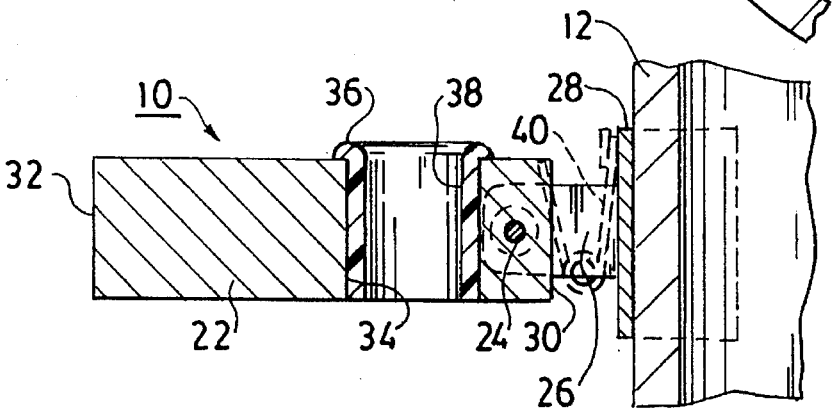

Referring also to FIGS. 2 and 3, runaway halyard stop 10 comprises a stop body 22 which is pivotally mounted on pivot pin 24 carried by the arms 26 of a support 28 that is fastened to mast 12 by screws. For purposes of this description, the right-hand end of elongated stop body 22, through which pivot pin 24 is received, will be referred to as pivot end 30, while the opposite end of stop body 22 will be referred to as cantilever end 32.

A hole 34 is formed through stop body 22 and, while the hole can be located anywhere along the length of stop body 22, it is preferably located in proximity to its pivot end 30. Also, hole 34 is preferably lined with a bushing 36, the interior walls of bushing 36 forming a passageway 38 through stop body 22.

Figure 4A:
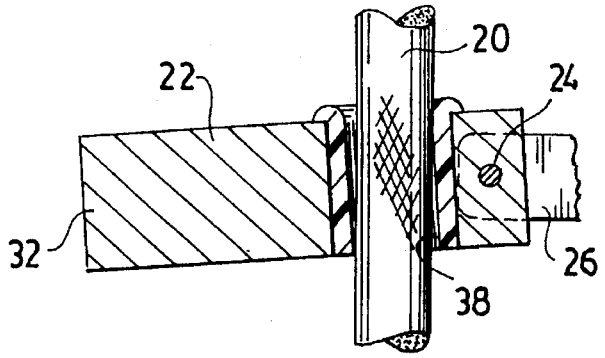
FIGS. 4A and 4B are schematic representations of views similar to FIG. 3, showing a halyard threaded through the passageway formed in the body of my stop, FIG. 4A showing the relative position of the stop when the halyard is under tension, and FIG. 4B showing the relative position of the stop when the halyard is not under tension.
Figure 4B:
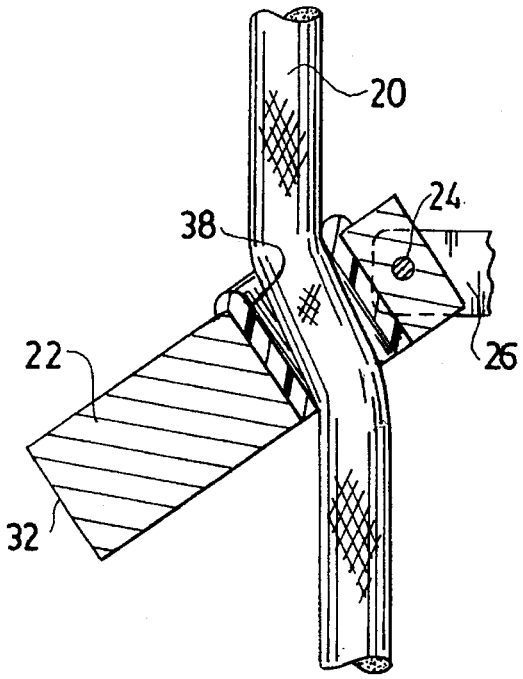

FIGS. 4A and 4B are schematic representations of stop body 22 with the working length 20 of the sail halyard threaded there through. As long as working length 20 is under tension, working length 20 overcomes the relatively small biasing force created by the weight of cantilever end 32, and stop body 22 is moved to the position shown in FIG. 4A with passageway 38 being substantially aligned with the halyard-under-tension direction of halyard 20. When in this first position, the walls of passageway 38 create little, if any, frictional resistance to the movement of working length 20 in either direction.

However, whenever tension is removed from working length 20 of the sail halyard, the relatively slight bias provided by the weight of cantilever end 32 causes stop body 22 to rotate about pivot pin 24; and this rotation is sufficient to move stop body 22 to a second position in which passageway 38 is out of alignment with the halyard-under-tension direction so that the walls of passageway 38 bind upon working length 20 and create sufficient frictional resistance to prevent the movement of working length 20.

With some types of halyard, that portion of the halyard which rides over the pulley is wire and, under some conditions, the wire portion of the halyard may be received through passageway 38 at a time when tension on the halyard may be lost. In order to assure that the walls of passageway 38 will be moved far enough out of alignment with the halyard-under-tension direction to create sufficient frictional resistance to the movement of the untensioned wire, it may be necessary to provide additional bias for stop body 22. This can be provided by a supplemental spring 40 (shown in FIGS. 2 and 3 with dotted lines).

Figure 5:
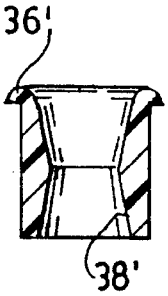
FIG. 5 is a cross-sectional view of an insertable-cartridge bushing which can be used to line the walls of the passageway formed in my stop body.

In preferred embodiments of the invention, bushing 36 may be provided in the form of an insertable cartridge 36' as shown in FIG. 5. The outside diameter of each cartridge 36' is appropriately dimensioned to fit snugly within hole 34 of stop body 22, while the size and shape of the interior walls 38' of cartridge 36' may be provided with interior dimensions that vary appropriately in accordance with the material and diameter of the halyard to which my runaway stop is being applied. Also, the shape of interior walls 38' may be empirically modified as necessary to control the frictional resistance between my runaway stop and the respective type of halyard with which it is being used. For instance, in the particular embodiment illustrated in FIG. 5, the interior diameter of the central portion of interior walls 38' of bushing 36' is smaller than the interior diameter of the end portions of interior walls 38'. This hour-glass shape may increase frictional resistance with some halyard materials.

The interior walls of bushing 36 (and insertable bushings 36') are chamfered and appropriately finished so that passageways 38, 38' have no sharp edges to cause unnecessary wear to the halyard. Insertable bushings 36' are preferably molded from a hard thermosetting or thermoplastic resin, e.g., Teflon (polytetrafluoroethylene).

As indicated earlier, the halyard of sail-raising tackle will run away if tension is lost at any time when the respective weights of its working and lifting lengths are unbalanced enough about the tackle's block (pulley) to create a rotational moment sufficient to overcome its relatively small friction. Such a runaway condition can be initiated when the working length of the line is only a few feet longer than the lifting length (or visa versa) and, once initiated, the difference in weight between the two lengths immediately begins to increase very rapidly thereafter. Therefore, to assure the efficacy of my runaway halyard stop, its ability to prevent a runaway was tested for the fairly extreme condition in which the lengths differed in length by a ratio of 10:1.

Figure 6:
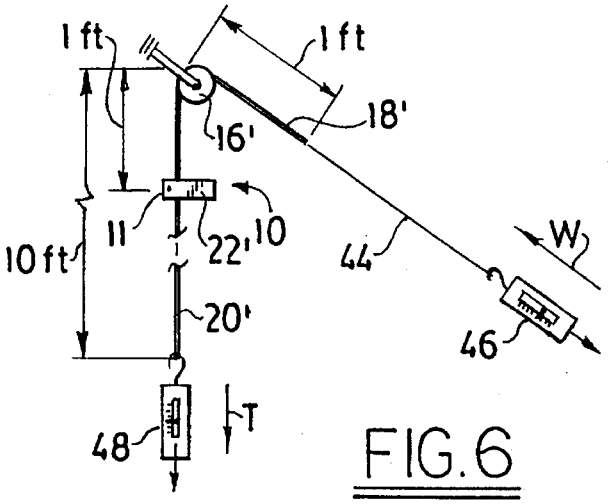
FIG. 6 is a schematic representation of test apparatus used to determine the efficacy of my stop body.

Five different diameter lines were tested in a loft with apparatus illustrated schematically in FIG. 6. Each respective line was passed over a pulley 16' (a Schaeffer Head Block 504–05) and threaded through my stop in the manner described above. Stop body 22' was mounted 1.0 feet (30 cm) below pulley 16'. In each test, the working length 20' was 10 feet (300 cm) long, while the lifting length 18' was only 1 foot (30 cm) long. To maintain the lifting length in position for the test, the lifting end was attached to nylon fishing line 44. The tested stop body 22' was made from an 8 oz. block of stainless steel that was 2.0 inches (5 cm) long, i.e., measured from its pivot end 30 (see FIGS. 2 and 3) to its cantilever end 32; 1.25 inches (3.75 cm) wide; and 0.875 inches (2.2 cm) high. Passageway 38 had a diameter of 0.54 inches (1.35 cm), with its center being located 0.64 inches (1.60 cm) from pivot end 30. All five lines were West Marine Sta-Set Polyester Braid.

The tests measured (1) the difference W by which the weight of working length 20' exceeded the weight of lifting length 18'; (2) the tension T that had to be exerted on working length 20' in order to bring the interior walls of passageway 38 of stop body 22' into substantial alignment with the halyard-under-tension direction so that they created little, if any, frictional resistance to the movement of working length 20'; and (3) the result when the tension on lifting length 18' was suddenly released. The values for W and T for each line tested were measured with a pull digital scale 46, 48 (Normak Model 10) and are set forth in the following table:

| Line Size | | W | | T | |
|---|---|---|---|---|---|
| inches | cm | oz. | grams | oz. | grams |
| ½ | 1.25 | 8 | 224 | 38 | 1064 |
| 7/16 | 1.10 | 6 | 168 | 10 | 280 |
| ⅜ | 0.94 | 4 | 112 | 10 | 280 |
| 5/16 | 0.78 | 3 | 84 | 8 | 224 |
| ¼ | 0.63 | 2 | 56 | 5 | 140 |

In tests of each of the different diameter lines listed above, tension was suddenly removed from lifting length 18'. In each test, the almost instantaneous frictional resistance created between my runaway halyard stop and the line was sufficient to prevent it from running off pulley 16'. On the other hand, as long as the line was under the relatively small tension T indicated in the table, working length 20' moved freely through passageway 38 in stop body 22'.

I claim:

1. A runaway halyard stop for tackle used for raising an object to a predetermined location positioned above a boat deck, said tackle having:

a pulley fastened to a mast at a position above said predetermined location;

a halyard having a lifting end for attachment to said object and a working end for securing said raised object in a location above said deck, said halyard having a bight running through said pulley, said bight having a lifting length positioned between said pulley and said lifting end and having a working length positioned between said pulley and said deck;

said halyard being placed under tension whenever said object is raised to and secured in said predetermined location, and said working length being aligned in a predetermined halyard-under-tension direction whenever said halyard is under tension;

said runaway halyard stop comprising:

a stop body adapted to be pivotally attached to said mast at a preselected location below said pulley, said stop body including a passageway with walls through which the working length of said halyard bight is passed, said pivoted stop body being movable between:

a first position in which said passageway is substantially aligned with said halyard-under-tension direction so that its walls create little, if any, frictional resistance to movement of said working length, and a second position in which said passageway is out of alignment with said halyard-under-tension direction so that its walls create frictional resistance to movement of said working length; and said stop body is biased toward said second position by a force selected so that said frictional resistance created by said passageway walls is sufficient to prevent movement of said working length whenever said halyard is not under tension but is insufficient to prevent movement of said working length whenever said halyard is under tension.

2. The runaway halyard stop of claim 1 wherein said stop body is biased toward said second position by a spring.

3. The runaway halyard stop of claim 1 wherein said stop body has an elongated shape and is pivotally attached to said mast at one of its ends so that its other end is a cantilever.

4. The runaway halyard stop of claim 3 wherein said passageway is located in proximity to said pivoted end and the weight of said cantilever end biases said stop body toward said second position.

5. The runaway halyard stop of claim 1 wherein the walls of said passageway comprise the interior walls of a bushing.

6. The runaway halyard stop of claim 5 wherein said bushing comprises an insertable cartridge having interior walls formed with a predetermined shape and size.

7. The runaway halyard stop of claim 6 wherein the interior diameter of the central portion of said interior walls is smaller than the interior diameter of the end portions of said interior walls.

8. The runaway halyard stop of claim 5 wherein said bushing comprises a thermoplastic resin material.

9. A runaway halyard stop for tackle used for raising an object to a predetermined location above a deck, said tackle having:

a pulley fastened to a support at a position above said predetermined location;

a halyard having a lifting end for attachment to said object and a working end for securing said raised object in said predetermined location, said halyard having a bight running through said pulley, and said bight having a lifting length positioned between said pulley and said lifting end and having a working length positioned between said pulley and said deck;

said halyard being placed under tension whenever said object is raised to said predetermined location, and said working length being aligned in a predetermined halyard-under-tension direction whenever said halyard is under tension;

said runaway halyard stop comprising:

a stop body having a pivot and a passageway with walls through which said working length of the halyard can be threaded;

said pivot being adapted for attachment to said support at a location between said pulley and said deck so that, whenever said halyard is under tension, said stop body is moved to a first position in which said passageway is substantially aligned with said halyard-under-tension direction and so that said passageway walls create little, if any, frictional resistance to movement of said working length; and a biasing force for urging said stop body rotationally about said pivot to a second position in which said passageway is out of alignment with said halyard-under-tension direction and said passageway walls create frictional resistance to movement of said working length, said biasing force being selected so that, whenever said halyard is not under tension, said force pivots said stop body to said second position in which said frictional resistance created by said passageway walls is sufficient to prevent movement of said working length but, whenever said halyard is under tension, said force is insufficient to pivot said stop body away from said first position.

10. The runaway halyard stop of claim 9 wherein said biasing means is a spring.

11. The runaway halyard stop of claim 9 wherein said stop body has an elongated shape and said pivot is located at one of its ends so that its other end is a cantilever.

12. The runaway halyard stop of claim 11 wherein said passageway is located in proximity to said pivoted end and the weight of said cantilever end biases said stop body toward said second position.

13. A runaway halyard stop for tackle used for raising an object to a predetermined location above a deck, said tackle having:

a pulley fastened to a support at a position above said predetermined location;

a halyard having a lifting end for attachment to said object and a working end for securing said raised object in said predetermined location, said halyard having a bight running through said pulley, and said bight having a lifting portion positioned between said pulley and said lifting end and having a working portion positioned between said pulley and said deck, the respective weight of said lifting and working portions being proportional to their respective lengths;

said halyard being placed under tension whenever said object is raised to said predetermined location, and said working length being aligned in a predetermined halyard-under-tension direction whenever said halyard is under tension;

said runaway halyard stop comprising:

a pivoted stop body having a passageway with walls through which said working length of the halyard can be threaded;

said pivoted stop body being adapted for attachment to said support at a location between said pulley and said deck so that, whenever said halyard is under tension, said stop body is pivoted to a first position in which said passageway is substantially aligned with said halyard-under-tension direction and so that said passageway walls create little, if any, frictional resistance to movement of said working length; and a biasing force for urging said pivoted stop body rotationally to a second position in which said passageway is out of alignment with said halyard-under-tension direction and said passageway walls create frictional resistance to movement of said working length, said biasing force being selected so that:

whenever said respective weights of said lifting and working portions are unbalanced about said pulley and said halyard is not under tension, said stop body is pivoted to said second position by said biasing force and said frictional resistance created by said passageway walls is sufficient to prevent movement of said working length, but whenever said halyard is under tension, said biasing force is insufficient to pivot said stop body away from said first position.

* * * * *